US005468161A

United States Patent [19]

Wright

[11] Patent Number: 5,468,161

[45] Date of Patent: Nov. 21, 1995

[54] SEMI-PERMANENT ELECTRICAL CONNECTOR AND BACKSHELL ASSEMBLY

[75] Inventor: James R. Wright, Guilford, N.Y.

[73] Assignee: Simmonds Precision Engine Systems, Inc., Akron, Ohio

[21] Appl. No.: 268,704

[22] Filed: Jun. 29, 1994

[51] Int. Cl.[6] ..... H01R 9/03

[52] U.S. Cl. ..... 439/610; 439/321

[58] Field of Search ..... 439/319, 320, 439/321, 323, 607, 610, 701, 901, 905; 29/842, 857, 861

[56] References Cited

U.S. PATENT DOCUMENTS

| | | | |
|---|---|---|---|
| 3,971,614 | 7/1976 | Paoli et al. . | |
| 4,359,254 | 11/1982 | Gallusser et al. . | |
| 4,808,123 | 2/1989 | Dee et al. | 439/470 |
| 4,900,260 | 2/1990 | Drogo | 439/321 |
| 5,082,454 | 1/1992 | Tonkiss et al. | 439/320 |
| 5,246,379 | 9/1993 | Wright | 439/321 |

*Primary Examiner*—Khiem Nguyen
*Attorney, Agent, or Firm*—Kevin L. Leffel

[57] ABSTRACT

The invention relates to a semi-permanent backshell and connector assembly for use with a harness having a plurality of conductors. More particularly, the invention relates to a connector and backshell assembly that inhibits unauthorized service and repair. The invention comprises a connector, an annular adapter sleeve, and a backshell. The adapter sleeve defines a locking surface that has at least on dog extending therefrom. The dog engages tooth-like projections on the connector. The adapter sleeve can rotate relative to the cylindrical extension before the backshell is installed due to the at least one dog being displaceable away from the tooth-like projections, and the adapter sleeve cannot rotate relative to the cylindrical extension after the backshell is installed due to the stopping surface preventing the at least one dog from displacing away from the tooth-like projections.

22 Claims, 4 Drawing Sheets

SEMI-PERMANENT ELECTRICAL CONNECTOR AND BACKSHELL ASSEMBLY

The invention relates to a semi-permanent backshell and connector assembly for use with a harness having a plurality of conductors. More particularly, the invention relates to a connector and backshell assembly that inhibits unauthorized service and repair.

Harness and connector assemblies are well known in the art. A typical connector commonly used in aerospace applications is known as a "circular connector," and has an array of contacts disposed within a circular housing. The circular housing has a captive nut with an internal thread that is screwed on to a mating accessory thereby drawing the connector into a mating receptacle. The receptacle has contacts that mate with the connector contacts. One set of contacts may be male contacts, and the other set of contacts may be female contacts. The circular housing may be formed from metal or a fiber reinforced plastic. A wide array of such connectors are available from a variety of suppliers.

As known in the art, the connector may be supplied without the contacts which are subsequently crimped on the ends of insulated conductors and then inserted into the back of the connector. This type of connector has a locking mechanism that fixes the contacts in place upon insertion into the connector. The insulated conductors pass through a backshell which is installed to the back of the connector in a manner that covers and protects the conductors and contacts. A portion of the backshell also supports the conductors and may act as a strain relief. An outer sheath may then be applied over the insulated conductors which completes the harness. The sheath may be formed by braiding or weaving according to known techniques. The sheath may be attached to the backshell by a band tightened around a narrowed portion of the backshell. A metallic sheath can be attached to a metallic backshell by welding, brazing or soldering. An integral harness and backshell/connector assembly may thus be formed.

A two-piece backshell/connector assembly with a separable connector is desirable since it permits use of a wide array of over the counter connectors. However, in some cases, the connection between the backshell and the connector must be resistant to tampering by unauthorized personnel, but must also be conducive to authorized service and repair.

An example of a connector/backshell assembly that is resistant to tampering while permitting authorized service and repair is provided in U.S. Pat. No. 5,246,379 issued to Wright on Sep. 21, 1993 (hereinafter the '379 device). The '379 device utilizes a ratchet mechanism that permits only oneway rotation of a nut relative to a housing. The ratchet mechanism engages the housing by means of a plurality of detents disposed within holes in the housing. Reverse rotation of the nut relative to the housing is prevented by the ratchet and the detents. A special tool is used to disengage the detents from the housing thereby permitting reverse rotation and removal of the nut from an accessory. Thus, unauthorized service and repair or tampering is inhibited since a special tool is required to disassemble a backshell from a connector. The '379 device is certainly suitable for many applications, but a backshell/connector assembly having a higher resistance to tampering is desired for some applications.

Rotation of the backshell relative to the connector represents another concern, and some means for preventing rotation is generally desired. Two approaches have been used to prevent such rotation. Many circular connectors are supplied with tooth-like projections that may be engaged by mating projections on the backshell. Prior backshells that use this approach have a nut with an internal thread that is screwed on to a mating external thread on the connector housing which draws the backshell projections into engagement with the connector housing projections. This approach is suitable for many applications, but is unsuitable if the backshell/connector assembly must be resistant to tampering since the nut can be easily removed. Alternatively, the backshell may be "staked" to the connector by drilling a transverse hole in the backshell and connector housing where the backshell housing fits over the connector housing and inserting a pin into the hole. The pin is then welded to the backshell. This approach inhibits tampering, but is undesirable for a composite (reinforced plastic) connector housing since the drilling operation may cause damage which can later result in mechanical failure. Heat from welding the pin can also damage a composite connector.

Therefore, a harness and connector/backshell assembly is desired that is conducive to authorized repair and service, but is highly resistant to tampering or unauthorized repair and service. An effective way of preventing rotation of the backshell relative to the connector is also desired in such an assembly, especially for use with a composite circular connector.

SUMMARY OF THE INVENTION

According to an aspect of the invention, a backshell and connector assembly is provided for use with a harness assembly having a plurality of conductors, comprising:

a connector having a cylindrical extension projecting therefrom that terminates in an endface, the endface having a periphery and tooth-like projections extending from the endface at the periphery, the conductors being connected to a plurality of contacts disposed within the connector such that the conductors extend from the endface;

an annular adapter sleeve that receives and holds the cylindrical extension with the conductors passing through the adapter sleeve, the adapter sleeve defining a locking surface within the adapter sleeve that faces the endface with the tooth-like projections in close proximity to the locking surface, the locking surface having at least one dog extending therefrom that engages the tooth-like projections, the at least one dog being displaceable away from the tooth-like projections; and, a backshell for supporting the conductors, the backshell having a tubular deformable portion that is installed over the adapter sleeve and held in place by deforming the deformable portion over a mating portion of the adapter sleeve, the backshell being engaged against rotation to the adapter sleeve, the backshell defining a stopping surface that prevents the at least one dog from displacing away from the tooth-like projections upon installation of the deformable portion over the adapter sleeve;

whereby the adapter sleeve can rotate relative to the cylindrical extension before the deformable portion is installed due to the at least one dog being displaceable away from the tooth-like projections, and the adapter sleeve cannot rotate relative to the cylindrical extension after the deformable portion is installed due to the stopping surface preventing the at least one dog from displacing away from the tooth-like projections.

According to another aspect of the invention, a method is provided for fabricating a harness assembly, comprising the steps of:

providing a circular connector having a cylindrical extension projecting therefrom that terminates in an endface, the endface having a periphery and tooth-like projections extending from the endface at the periphery, the connector having a plurality of contacts disposed within the housing;

providing a plurality of conductors connected to the plurality of contacts and extending from the endface;

providing an annular adapter sleeve that receives and holds the cylindrical extension;

providing a backshell that supports the conductors, the backshell having a tubular deformable portion;

inserting the cylindrical extension into the adapter sleeve, the adapter sleeve defining a locking surface within the adapter sleeve that faces the endface with the tooth-like projections in close proximity to the locking surface, the locking surface having at least one dog extending therefrom that engages the tooth-like projections, the at least one dog being displaceable away from the tooth-like projections thereby permitting the adapter sleeve to rotate relative to the cylindrical extension;

inserting the adapter sleeve into the deformable portion such that the backshell is engaged against rotation to the adapter sleeve, the backshell defining a stopping surface that restrains the at least one dog against the tooth-like projections thereby preventing the adapter sleeve from rotating relative to the cylindrical extension; and, deforming the deformable portion over a mating portion of the adapter sleeve.

According to yet another aspect of the invention, the method of fabricating a wire harness assembly as stated above may further comprise the steps of:

severing the deformable portion from the backshell;

removing the backshell;

providing a new backshell that supports the conductors, the new backshell having a new tubular deformable portion;

inserting the adapter sleeve into the new deformable portion such that the new backshell is engaged against rotation to the adapter sleeve, the new backshell defining a stopping surface that restrains the at least one dog against the tooth-like projections thereby preventing the adapter sleeve from rotating relative to the cylindrical extension; and, deforming the new deformable portion over a mating portion of the adapter sleeve.

The invention thus provides a harness and connector/backshell assembly that is conducive to authorized repair and service, but is highly resistant to tampering or unauthorized repair and service. The invention also provides an effective way of preventing rotation of the backshell relative to the connector, especially for use with a composite circular connector.

DETAILED DESCRIPTION

Figures 1, 2:
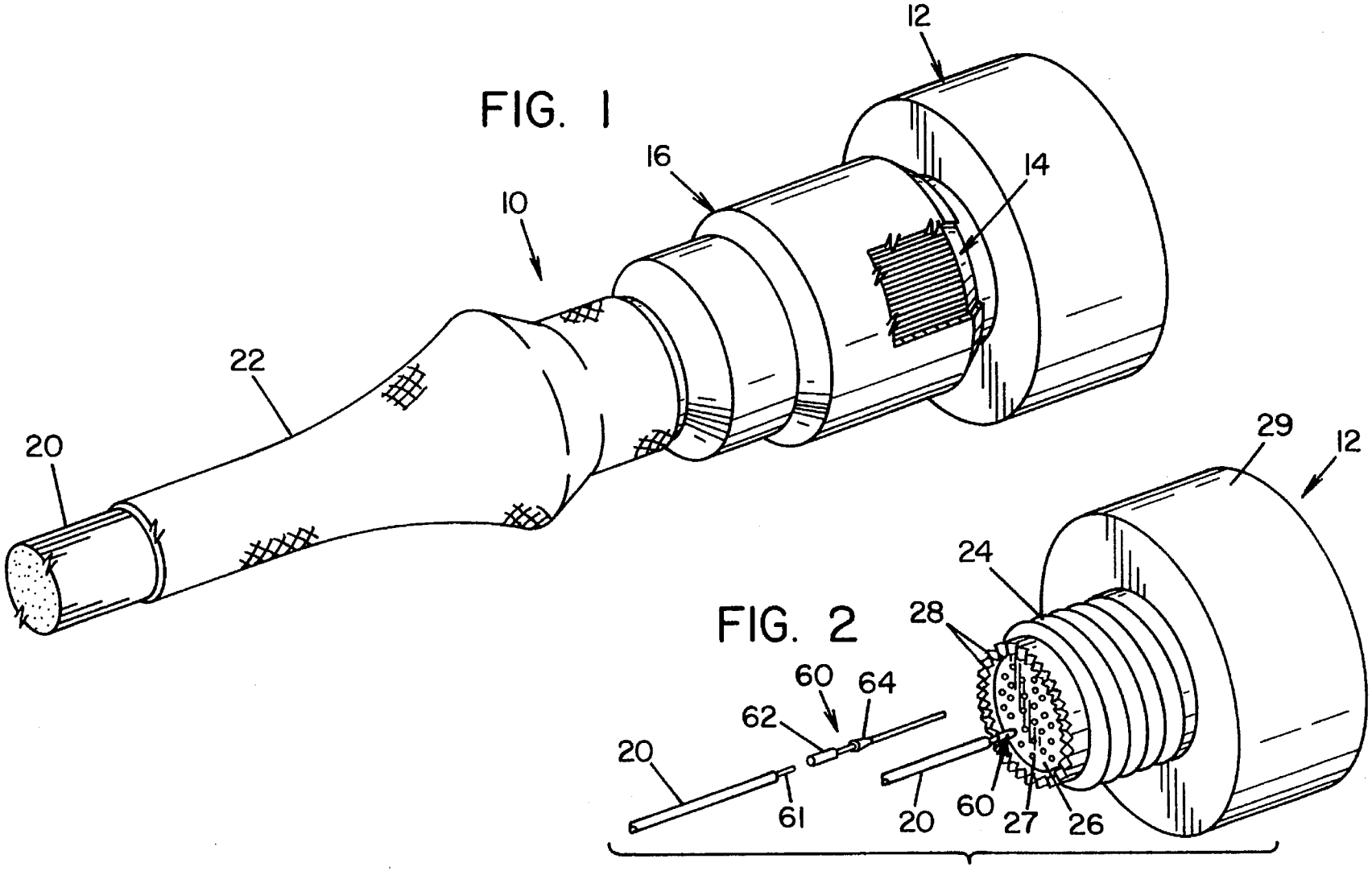
FIG. 1 is a perspective view of a harness and backshell/connector assembly showing a cutaway portion of the backshell.
FIG. 2 is a perspective view of a circular connector suitable for use in embodying the invention.

Various embodiments of a backshell and connector assembly according to the invention for use with a harness assembly having a plurality of conductors are depicted in FIGS. 1–11, wherein like numbered components are equivalent. Referring to FIG. 1, a harness assembly 10 according to an aspect of the invention is depicted comprising a circular connector 12, a backshell 16, an adapter sleeve 14 as seen through a broken-away section of the backshell 16, a plurality of conductors 20, and a protective sheath 22. The harness assembly 10 transfers signals or electrical power from one device to another. It is to be understood that the invention has equal utility for use with electrical conductors that conduct electrical energy, or optical conductors that conduct light energy. The term "conductor" as used herein and in the appended claims is intended to cover both electrical and optical conductors. A conventional insulated wire conductor is an example of an electrical conductor suitable for use with the invention. An optical fiber having a protective covering is an example of an optical conductor suitable for use with the invention. Such conductors are well known in the art. A harness may be completely electrical and have only electrical conductors, or completely optical and have only optical conductors, or "hybrid" and have electrical and optical conductors. The invention finds equal utility in any of these variations.

Referring now to FIG. 2, a perspective view of the back of a preferred circular connector 12 for use with the invention is provided. The circular electrical connector 12 has a cylindrical extension 24 projecting therefrom that terminates in an endface 26. The endface 26 has a periphery and tooth-like projections 28 extending from the endface 26 at the periphery. The endface 26 is adapted to receive a plurality of contacts 60 by means of a plurality of holes 27 that perforate the endface 26. In a preferred embodiment, the contacts 60 are attached to the ends of the conductors 20 and inserted into the holes 27. In other types of connectors, the contacts are permanently disposed within the housing and the conductors are directly attached to the connector, for example by soldering in the case of an electrical conductor. A hermetic connector is an example of a connector that requires such an arrangement. Various equivalent arrangements are known in the art any of which are useful in the practice of the invention. The term "contacts" as used herein and in the appended claims is intended to cover both electrical contacts, and optical contacts for use with optical conductors (generally known as "termini").

According to a preferred embodiment, each contact 60 comprises a receptacle portion 62 and a catch portion 64. A stripped end 61 of the conductor 20 is inserted into the receptacle portion 62. In the case of an electrical conductor and contact, the end 61 of the conductor 20 is permanently attached by crimping the receptacle portion 62 to the conductor 20. In the case of an optical conductor and contact, the end 61 of the conductor 20 is adhesively bonded into the receptacle portion 62 with a suitable epoxy adhesive. The contact 60 is then inserted through a hole 27 in endface 26 until the catch portion 64 engages a mating catch in the connector 12 that locks the contact within the connector 12. In such manner, the conductors 20 are connected to the contacts 60 which are disposed within the connector 12 such that said conductors 20 extend from the endface 26.

A nut 29 is captive on the connector 12 and has an internal thread (not shown). The nut 29 may be screwed onto an accessory having a mating external thread thereby drawing the connector contacts 60 into mating contacts (not shown) in the accessory. The connector housing, which includes the nut 29 and cylindrical extension 24, may be formed from metal or a composite (reinforced plastic) material. Thus, the tooth-like projections may be either metal or composite. Suitable connectors for use with the invention are specified by MIL-C-38999, and are available from sources listed on the qualified products list for that specification. Other types of circular connectors are equally suitable in the practice of the invention. Any connector having features similar to the cylindrical extension 24, endface 26, and tooth-like projections 28 is suitable for use with the invention.

Figure 3:
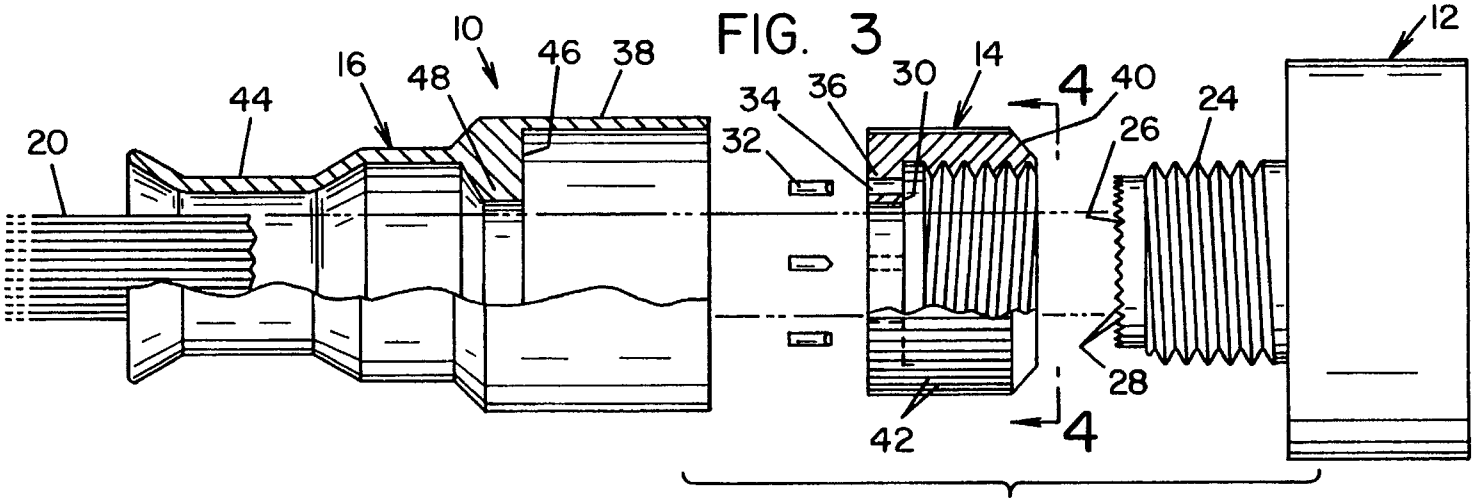
FIG. 3 is an exploded side view of one embodiment of the FIG. 1 backshell/connector assembly.
Figure 6:
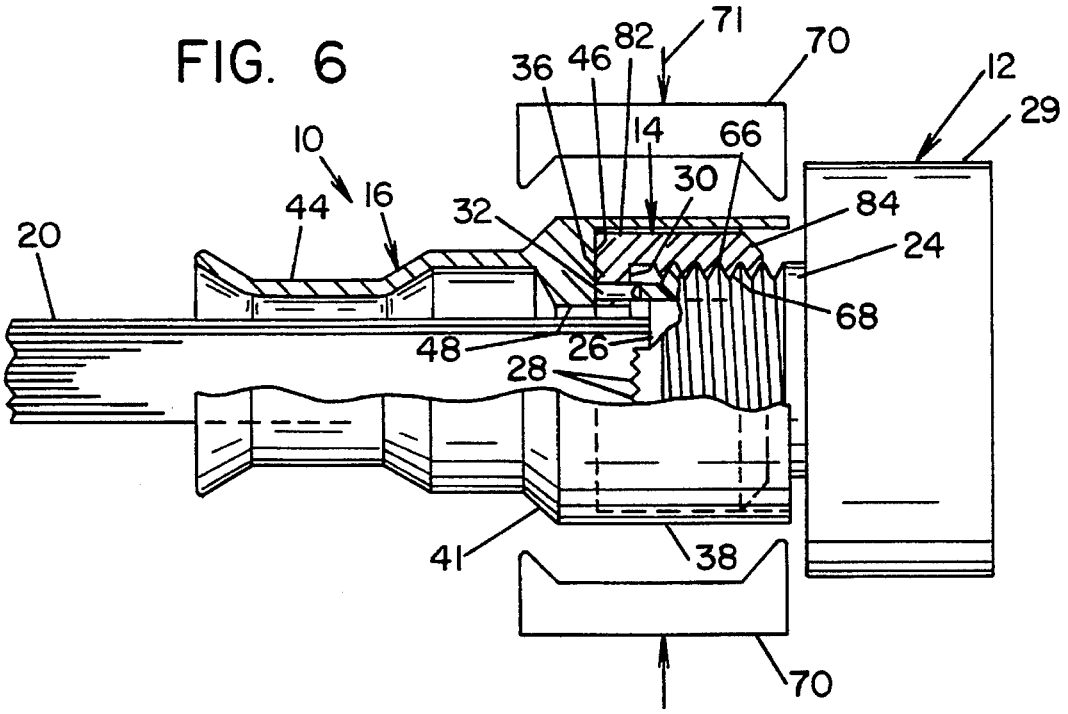
FIG. 6 is a side view of one embodiment according to the invention showing the backshell before deformation over the adapter sleeve.

Referring now to FIGS. 3 and 6, side views of assembly 10 before and after assembly are depicted. A connector 12 is provided as previously described. The adapter sleeve 14 has an annular shape, and receives and holds the cylindrical extension 24. The adapter sleeve 14 has a shoulder 36 that defines a locking surface 30 within the adapter sleeve 14. Upon installation of the adapter sleeve 14 over the cylindrical extension 24, the locking surface 30 faces the endface with the tooth-like projections 28 in close proximity to the locking surface 30. According to a preferred embodiment, the cylindrical extension 24 has an external thread 66, the adapter sleeve 14 has a mating internal thread 68, and the adapter sleeve 14 is screwed on to the cylindrical extension 24. The locking surface 30 has at least one dog extending therefrom that engages the tooth-like projections 28 such that the dog is displaceable away from the tooth-like projections before installation of backshell 16. In this embodiment, the dog is a pin 32 extending therefrom that engages the tooth-like projections 28. Each pin 32 is inserted into a hole 34 in the shoulder 36 that permits each pin 32 to displace away from the tooth-like projections before the backshell 16 is installed over the adapter sleeve 14.

Figure 7:
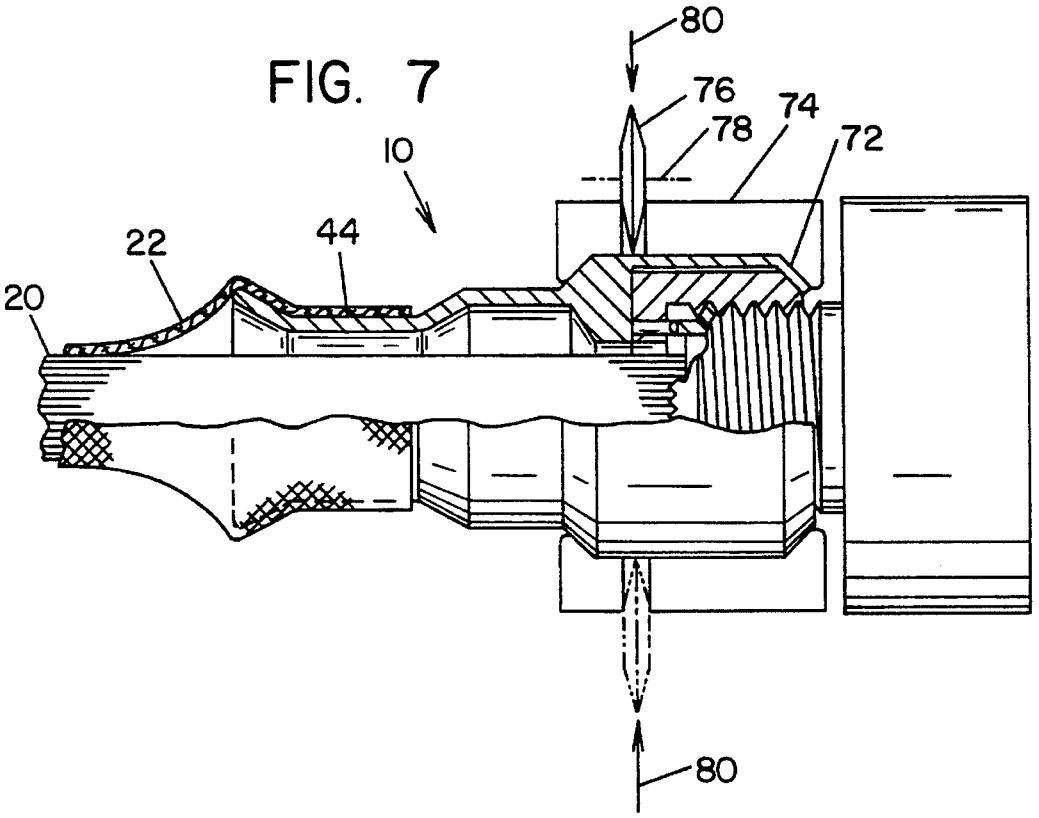
FIG. 7 is a side view of the FIG. 6 embodiment after the backshell is deformed over the adapter sleeve.

The backshell 16 has a tubular deformable portion 38 that is installed over the adapter sleeve 14 and held in place by deforming the deformable portion over a mating portion 40 of the adapter sleeve 14 as shown in FIGS. 6 and 7. Still referring to FIGS. 3 and 6, the backshell 16 has a shoulder 48 that defines a stopping surface 46. Stopping surface 46 prevents the pins 32 from displacing away from the tooth-like projections 26 upon installation of the deformable portion 38 over the adapter sleeve 14, which prevents relative rotation between the adapter sleeve 14 and the cylindrical extension 24.

In order to fully prevent rotation, the backshell 16 is preferably engaged against rotation to the adapter sleeve 14, which in this embodiment, is accomplished by means of a press fit straight knurl 42 on the exterior surface of the adapter sleeve 14. Other variations are possible such as a keyway and mating key in the backshell and adapter sleeve, or mating splines, or other functionally equivalent configurations for preventing relative rotation, any of which are considered to be within the purview of the invention. The backshell 16 also supports the conductors 20 at a narrowed portion 44. The conductor support arrangement is not critical in the practice of the invention, and can utilize any of a number of known variations including a halfshell clamp and a conduit adapter, any of which are considered to be within the purview of the invention.

Figure 4:
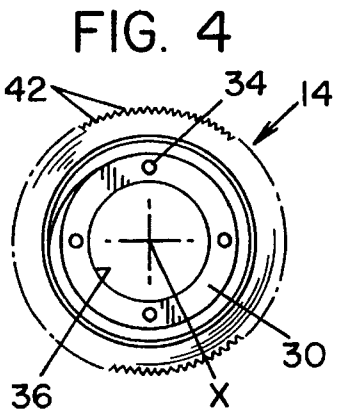
FIG. 4 is an end view of one embodiment of an adapter sleeve taken along line 4—4 of FIG. 3.

Referring now to FIG. 4, an end view of adapter sleeve 14 is presented along line 4—4 of FIG. 3. Shoulder 36 and locking surface 30 are annular in the embodiment presented. The straight knurl 42 is shown on the exterior surface of the adapter sleeve 14. The axis of rotation X of the backshell 16 relative to the adapter sleeve 14 is perpendicular to the page in this view, and the straight knurl 42 is aligned generally parallel to the axis of rotation. The number of pins 32 used depends on the desired degree of resistance to rotation and may vary from one to many depending on the application. In this embodiment, four pins 32 are used and the respective holes 34 are equidistantly spaced around the shoulder 36. Using a plurality of pins 32 rather than a single pin 32 is preferable since resistance to rotation between the adapter sleeve 14 and the cylindrical extension 24 is thereby increased. Adapter sleeve 14 is preferably formed from a metal such as stainless steel, an aluminum alloy, or a nickel plated brass.

Figure 5C:
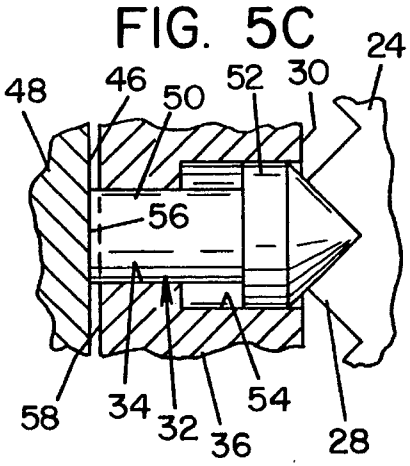
FIG. 5C is a detailed sectional view of yet another pin suitable for use with the FIG. 4 adapter sleeve.
Figure 5B:
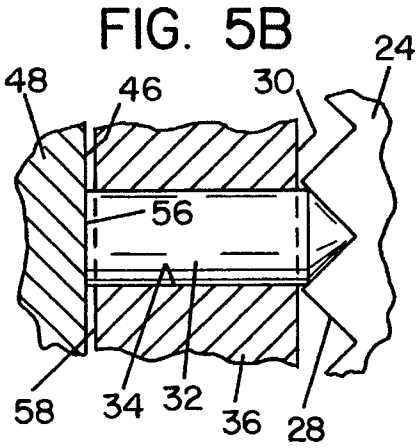
FIG. 5B is a detailed sectional view of another pin suitable for use with the FIG. 4 adapter sleeve.
Figure 5A:
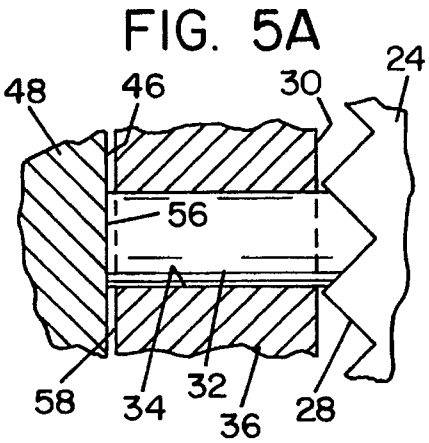
FIG. 5A is a detailed sectional view of a pin suitable for use with the FIG. 4 adapter sleeve.

Referring now to FIG. 5A, a detailed view of pin 32 and adapter sleeve shoulder 36 after the backshell is installed is presented. Locking surface 30 is in close proximity to the tooth-like projections 28, and pin 32 is received within hole 34 projecting from locking surface 30. Upon installation of the backshell, the stopping surface 46 defined by shoulder 48 restrains the pin 32 from displacing away from the tooth-like projections 28. In this embodiment, the pin 32 has a chisel point that engages tooth-like projections 28. In such manner, relative rotation between the adapter sleeve 14 and the cylindrical extension 24 is prevented after the backshell is installed over the adapter sleeve 14. An identical arrangement is presented in FIG. 5B, except that pin 32 has a conical point instead of a chisel point. Another embodiment is shown in Figure 5C in which the locking surface 30 is counterbored over each hole 34, and each pin 32 has a first portion 50 that is received within the hole 34 and a second portion 52 that has an enlarged diameter that is received within the counterbore 54. In this embodiment, the pin 32 is captive between shoulder 36 and the tooth-like projections 28.

In all three embodiments presented in FIG. 5A–5C, the stopping surface 30 preferably presses the pin 32 against the tooth-like projections 28 after the backshell is installed and maintains this contact during service. Thus, top surface 56 of pin 32 is preferably at least flush with top surface 58 of shoulder 36, and most preferably projects a small distance above the shoulder top surface 58. If the pin top surface 56 falls below the shoulder top surface 58, the stopping surface 46 will rest against shoulder top surface 58 and permit the pin 32 to slide back and forth in the hole 34. This prevents the pin 32 from locking the adapter sleeve against rotation relative to the cylindrical extension 24, which is undesirable. Likewise, pin 32 should be formed from a sufficiently stiff material to prevent it from compressing and loosening engagement with the tooth-like projections 28 during installation of the backshell and during subsequent service. Pin 32 is preferably formed from a metal, such as stainless steel.

Referring now to FIGS. 6 and 7, a method for fabricating an electrical harness assembly according to the invention is depicted. Referring to FIG. 6, insulated conductors 20 are provided with each conductor terminating in a contact, as previously described in relation to FIG. 2. A circular electrical connector 12, adapter sleeve 14, and backshell 16 are provided having features as previously described in relation to FIGS. 2 and 3. Still referring to FIG. 6, the insulated conductors 20 are then inserted through the backshell 16 and the adapter sleeve 14 and the contacts are inserted into the endface 26. If the FIG. 5A and 5B pin embodiments are used, the cylindrical extension 24 is then inserted into the adapter sleeve 14. The pins 32 are inserted into holes 34 of shoulder 36 after the adapter sleeve 14 is installed over cylindrical extension 24. If the FIG. 5C pin embodiment is used, the pins 32 are inserted into the holes 34 in shoulder 36 before the cylindrical extension 24 is inserted into the adapter sleeve 14. At this point a small amount of rotational adjustment between adjuster sleeve 14 and cylindrical extension 24 may be necessary to align the pins into proper engagement between the tooth-like projections 28. According to a preferred embodiment, the cylindrical extension 24 has an external thread 66, the adapter sleeve 14 has a mating internal thread 68, and the adapter sleeve 14 is screwed on to the cylindrical extension 24.

The adapter sleeve 14 is then inserted into the deformable portion 38 of backshell 16 and is pushed toward the connector 12 until the stopping surface 46 abuts the pins 32. The stopping surface 46 thus restrains the pins 32 against the tooth-like projections 28 thereby preventing the adapter sleeve 14 from rotating relative to the cylindrical extension 24 after the backshell 16 is installed. The deformable portion 38 is then deformed over a mating portion of the adapter sleeve 14. In a preferred embodiment, the adapter sleeve 14 has a first end 82 furthest from the circular connector 12 and a second end 84 spaced from the first end toward the circular connector 12. The first end 82 faces the stopping surface 46. The second end 84 is conically shaped, and the backshell 16 is installed by swaging the deformable portion 38 over the second end 84. The first die 70 may be rotated relative to backshell 16 as it is forced in the direction of arrow 71 during deformation thus forming a smooth and continuous lip 72 over conical face 40, as shown in FIG. 7. The backshell 16 preferably has a conical face 41 that cooperates with the first die 70 and conical face 40 to develop a compressive force that firmly presses the adapter sleeve 14 into backshell 16. Firm contact between the stopping surface 46 and pins 32 is thus assured. The deformable portion 38 is preferably formed from a metal such as a stainless steel, an aluminum alloy, or a nickel plated brass. The balance of the backshell 16 or parts thereof can be a metal, plastic, or fiber reinforced plastic, depending on the application. For practical reasons, the entire backshell would be formed of metal for most applications.

Thus according to the invention, the adapter sleeve 14 may rotate relative to the cylindrical extension 24 before the deformable portion 38 is installed due to pins 32 being displaceable away from the tooth-like projections 28, and the adapter sleeve 14 is engaged against rotation relative to the cylindrical extension 24 after the deformable portion 38 is installed due to the stopping surface 46 holding the pins 32 in engagement with the tooth-like projections 28. In a preferred embodiment where the adapter sleeve 14 and cylindrical extension 24 have mating threads, this feature permits the adapter sleeve 14 to be screwed on to the cylindrical extension 24 before the backshell 16 is installed, and prevents the adapter sleeve 14 from backing-off the cylindrical extension 24 after the backshell 16 is installed. Thus, the pins 32 perform a locking function as well as an anti-rotation function in this embodiment.

Referring now to FIG. 7, a completed wire harness assembly 10 is depicted. A sheath 22 is optionally installed over the conductors 20 and the end of the backshell 16. Sheath 22 may be braided or woven from metal or non-metal materials, as is known in the art, and serves to protect conductors 20 from abrasion. Examples of such materials include braided or woven fiberglass, aramid fiber such as Nomex®, stainless steel wire, or nickel plated copper wire if shielding from electromagnetic interference is desired. Nomex® is available from the E.I. du Pont de Nemours Company Inc., located in Wilmington, Del., U.S.A. Sheath 22 may be formed after the backshell/connector assembly and braided or woven over the end of the backshell 16 around narrowed portion 44 where it is permanently attached. The sheath 22 may be attached by bonding or by a constrictive band around the narrowed portion 44. The sheath 22 may also be attached by soldering, welding, or brazing if it and narrowed portion 44 are formed from metal. Any technique using heat should be used with caution in order to avoid damaging the conductors.

The backshell/connector assembly can be disassembled for service and repair as follows. The deformable portion 38 is severed from the backshell 16, and that adapter sleeve 14 is removed. Referring to FIG. 7, a preferred method for severing the deformable portion 38 is depicted wherein a second die 74 is clamped to the backshell 16. A circular cutting tool 76 that rotates about axis 78 is rolled around the backshell (as shown in phantom) as it is forced into the backshell in the direction of arrow 80 until the deformable portion is severed from the backshell 16. Circular cutting tool 76 essentially acts as a tubing cutter which is a very well known device in the mechanical arts. Thus, the backshell 16 is removed which releases pins 32. The adapter sleeve 14 can be removed once the pins 32 are released. At this point, the conductors 20 still pass through the backshell and adapter, which requires that the contacts be released from the connector 12 in order to permit removal of the backshell and adapter sleeve. A tool for releasing the contacts from the connector 12 is available from the connector manufacturer. After removing the backshell 16 and adapter sleeve 14 from the conductors 20, the severed deformable portion 38 is removed from the adapter sleeve 14 in a press or by any other suitable technique. Thus, the adapter sleeve 14 may be reused. A new backshell is provided and the backshell/connector assembly is reassembled using the new backshell according to the previously described procedures.

It is evident that tampering or unauthorized repair and service of the backshell and connector assembly according to the invention is extremely difficult. Any attempt to remove the backshell will damage the backshell and, therefore, is detectable. Outright removal of the backshell requires a new backshell and complete removal of the conductors from the connector along with reassembly which is a difficult and impossible task without the appropriate equipment and facilities. Any attempt to remove the backshell without severing the deformable portion would require opening the deformable portion and re-swaging it back over the adapter sleeve. This would also be detectable. Thus, tampering with the assembly is rendered extremely difficult and easy to detect after the fact.

Figure 8:
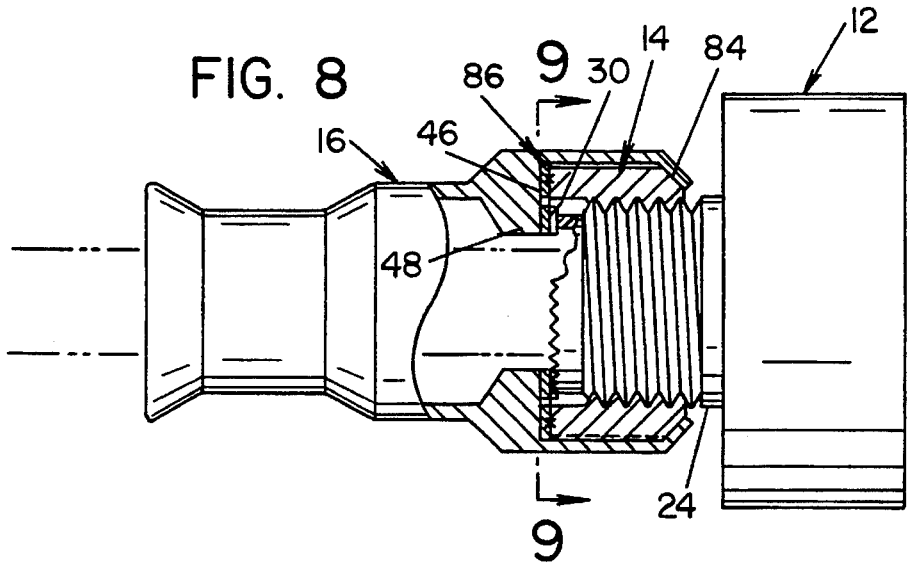
FIG. 8 is a side view of another embodiment according to the invention with a broken-away portion.

Referring to FIG. 8, another embodiment of adapter sleeve 14 is presented. A backshell/connector assembly is shown with the backshell 16 installed over the adapter sleeve 14 as previously described. In this embodiment, the adapter sleeve 14 has a first end 82 furthest from the circular connector 12 and a second end 84 spaced from the first end 82 toward the connector 12. A thin flat member 86 is engaged against rotation to the first end 82 such that the thin flat member defines the locking surface 30. The thin flat member 86 and adapter sleeve 14 may be made as a single piece. In a preferred embodiment, the thin flat member 86 and adapter sleeve 14 are separate pieces as depicted in FIG. 8.

Figure 9:
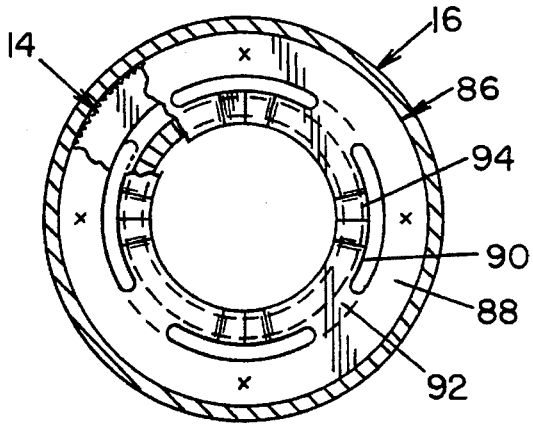
FIG. 9 is a view taken along line 9—9 of FIG. 8 showing a detailed view a thin flat member having detents projecting therefrom.

Referring to FIG. 9, the thin flat member 86 comprises an outer ring 88 and an inner ring 90 attached to the outer ring by a plurality of webs 92. In this embodiment, the dog comprises at least one detent 94 projecting from the inner ring 90. The thin flat member may be formed from metal having spring-like qualities. Stainless steel in sheet or strip form is preferred according to AMS 5604, AMS 5529, or AMS 5598, as specified by the AMS index (Aerospace Material Specifications) published by the Society of Automotive Engineers, Warrendale, Penn., U.S.A. The thin flat member 86 is attached to the adapter sleeve 14 by a process selected from the group consisting of welding, brazing, soldering, and mechanical fastening. These are functionally equivalent, though welding may be the most economic. Examples of a mechanical fastening technique includes screws, rivets, matching key and keyway, or equivalent techniques for preventing relative rotation.

Figure 10:
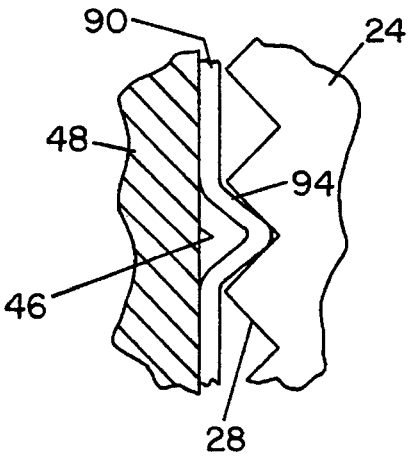
FIG. 10 is a detail view showing engagement of a detent with the circular connector according to the FIGS. 8 and 9 embodiment.

Referring to FIG. 10, the detent 94 is shown engaged with tooth-like projections 28 after installation of backshell 16. In this embodiment, detent 94 constitutes a deformed portion of inner ring 90 which could be formed by any suitable technique such as punching or stamping. Detent 94 could also constitute a rivet fastened to the thin flat member having a conical or chisel point head that engages the tooth-like projections. The rivet would be installed in a hole in the thin flat member and peened over on the side facing stopping surface 46. In either embodiment, stopping surface 46 of backshell shoulder 48 restrains the detent 94 against the tooth-like projections 28 which prevents rotation of the adapter sleeve 14 relative to the cylindrical extension 24.

Figure 11:
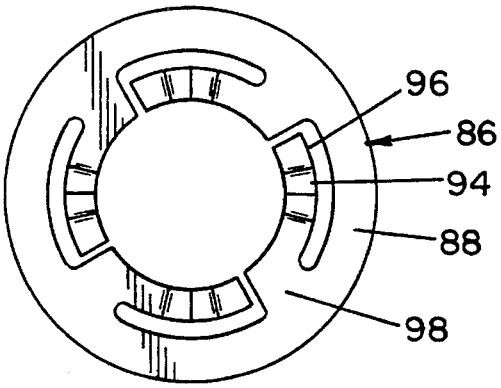
FIG. 11 is a plan view of an alternate embodiment of the thin flat member of FIG. 9.

An alternate embodiment for thin flat member 86 is presented in FIG. 11. In this embodiment, the thin flat member 86 comprises an outer ring 88 and a plurality of tines 96 concentric with the outer ring 88 and disposed within the outer ring 88. A web 98 attaches each tine to the outer ring 88, and a detent 94 projects from each tine 96. The detent 94 engages the tooth-like projections 28 in the same manner as depicted in FIG. 10.

In either the FIG. 9 or FIG. 10 embodiments, the adapter sleeve is preferably screwed onto the cylindrical extension 24. The detent 94 will begin to engage the tooth-like projections as the adapter sleeve 14 is tightened down. The inner ring 90 and tines 96 behave resiliently which allows the detent 94 to click over the tooth-like projections until the adapter sleeve is fully installed. In this respect, the FIG. 11 embodiment may be more desirable for use with a composite connector since the tines are more resilient than inner ring 90 which should allow the detents 94 to pass over the tooth-like projections 28 more easily without causing damage. With either embodiment, any resilience is eliminated when the backshell is installed in order to prevent the adapter sleeve from backing-off the cylindrical extension during service. The embodiments depicted in FIGS. 8 through 11 are functionally equivalent to the embodiments depicted in FIGS. 3 through 7 and operate according to the same principles.

It is evident that many variations are possible without deviating from the true scope and spirit of the invention as defined by the claims that follow.

I claim:

1. A backshell and connector assembly for use with a harness assembly having a plurality of conductors, comprising:

a connector having a cylindrical extension projecting therefrom that terminates in an endface, said endface having a periphery and tooth-like projections extending from said endface at said periphery, the conductors being connected to a plurality of contacts disposed within said connector such that the conductors extend from said endface;

an annular adapter sleeve that receives and holds said cylindrical extension with the conductors passing through said adapter sleeve, said adapter sleeve defining a locking surface within said adapter sleeve that faces said endface with said tooth-like projections in close proximity to said locking surface, said locking surface having at least one dog extending therefrom that engages said tooth-like projections, said at least one dog being displaceable away from said tooth-like projections; and, a backshell for supporting the conductors, said backshell having a tubular deformable portion that is installed over said adapter sleeve and held in place by deforming said deformable portion over a mating portion of said adapter sleeve, said backshell being engaged against rotation to said adapter sleeve, said backshell defining a stopping surface that prevents said at least one dog from displacing away from said tooth-like projections upon installation of said deformable portion over said adapter sleeve;

whereby said adapter sleeve can rotate relative to said cylindrical extension before said deformable portion is installed due to said at least one dog being displaceable away from said tooth-like projections, and said adapter sleeve cannot rotate relative to said cylindrical extension after said deformable portion is installed due to said stopping surface preventing said at least one dog from displacing away from said tooth-like projections.

2. The assembly of claim 1, wherein said tooth-like projections are formed from a composite material.

3. The assembly of claim 1, wherein said tooth-like projections are formed from a metal.

4. The assembly of claim 1, wherein said deformable portion is formed from a metal.

5. The assembly of claim 1, wherein said cylindrical extension has an external thread and said adapter sleeve has a mating internal thread, and said adapter sleeve is screwed on to said cylindrical extension.

6. The assembly of claim 1, wherein said adapter sleeve comprises a shoulder that defines said locking surface and said at least one dog comprises at least one pin that is received within at least one hole in said shoulder.

7. The assembly of claim 6, wherein said pin has a conical point that engages said tooth-like projections.

8. The assembly of claim 6, wherein said pin has a chisel point that engages said tooth-like projections.

9. The assembly of claim 6, wherein said locking surface is counterbored over each hole, and each pin has a first portion that is received within said hole and a second portion having an enlarged diameter that is received within said counterbore.

10. The assembly of claim 1, wherein:

said adapter sleeve has a first end furthest from said circular connector, said adapter sleeve includes a thin flat member engaged against rotation to said first end such that said thin flat member defines said locking surface, and said thin flat member comprises an outer ring and an inner ring attached to said outer ring by a plurality of webs, and said at least one dog comprises at least one detent projecting from said inner ring.

11. The assembly of claim 10, wherein said thin flat member is attached to said adapter sleeve by a process selected from the group consisting of welding, brazing, soldering, and mechanical fastening.

12. The assembly of claim 1, wherein:

said adapter sleeve has a first end furthest from said circular connector, said adapter sleeve includes a thin flat member engaged against rotation to said first end such that said thin flat member defines said locking surface, and said thin flat member comprises an outer ring and a plurality of tines concentric within said outer ring, and a web for each tine attaching each tine to said outer ring, and said at least one dog comprises a detent projecting from each tine.

13. The assembly of claim 12, wherein said thin flat member is attached to said adapter sleeve by a process selected from the group consisting of welding, brazing, soldering, and mechanical fastening.

14. The assembly of claim 1, wherein said adapter sleeve has a first end furthest from said circular connector and said stopping surface rests against said first end, and said adapter sleeve has a second end spaced from said first end toward said circular connector, said second end is conically shaped, and said backshell is installed by swaging said backshell over said second end.

15. The assembly of claim 1, wherein said adapter sleeve has an external surface over which said backshell is installed, and said backshell is engaged against rotation to said adapter sleeve by a straight knurl on said external surface that is aligned generally parallel to the axis of said rotation.

16. The assembly of claim 1, wherein said backshell may be removed from said adapter sleeve by severing said deformable portion from said backshell.

17. A method for fabricating a harness assembly, comprising the steps of:

providing a circular connector having a cylindrical extension projecting therefrom that terminates in an endface, said endface having a periphery and tooth-like projections extending from said endface at said periphery, said connector having a plurality of contacts disposed within said housing;

providing a plurality of conductors connected to said plurality of contacts and extending from said endface;

providing an annular adapter sleeve that receives and holds said cylindrical extension;

providing a backshell that supports said conductors, said backshell having a tubular deformable portion;

inserting said cylindrical extension into said adapter sleeve, said adapter sleeve defining a locking surface within said adapter sleeve that faces said endface with said tooth-like projections in close proximity to said locking surface, said locking surface having at least one dog extending therefrom that engages said tooth-like projections, said at least one dog being displaceable away from said tooth-like projections thereby permitting said adapter sleeve to rotate relative to said cylindrical extension;

inserting said adapter sleeve into said deformable portion such that said backshell is engaged against rotation to said adapter sleeve, said backshell defining a stopping surface that restrains said at least one dog against said tooth-like projections thereby preventing said adapter sleeve from rotating relative to said cylindrical extension; and, deforming said deformable portion over a mating portion of said adapter sleeve.

18. The method of claim 17, further comprising the steps of:

severing said deformable portion from said backshell;

removing said backshell;

providing a new backshell that supports said conductors, said new backshell having a new tubular deformable portion;

inserting said adapter sleeve into said new deformable portion such that said new backshell is engaged against rotation to said adapter sleeve, said new backshell defining a stopping surface that restrains said at least one dog against said toothlike projections thereby preventing said adapter sleeve from rotating relative to said cylindrical extension; and, deforming said new deformable portion over a mating portion of said adapter sleeve.

19. The method of claim 17, wherein said cylindrical extension has an external thread and said adapter sleeve has a mating internal thread, and further comprising the step of screwing said adapter sleeve on to said cylindrical extension.

20. The method of claim 17, wherein said step of deforming said deformable portion comprises the step of swaging said deformable portion over a mating portion of said adapter sleeve.

21. A method for servicing a backshell and connector assembly for use with a harness assembly having a plurality of conductors, comprising the steps of:

(a) providing a backshell and connector assembly comprising, a circular connector having a cylindrical extension projecting therefrom that terminates in an endface, said endface having a periphery and tooth-like projections extending from said endface at said periphery, the conductors being connected to a plurality of contacts disposed within said connector such that the conductors extend from said endface, an annular adapter sleeve that receives and holds said cylindrical extension with the conductors passing through said adapter sleeve, said adapter sleeve defining a locking surface within said adapter sleeve that faces said endface with said tooth-like projections in close proximity to said locking surface, said locking surface having at least one dog extending therefrom that engages said tooth-like projections, said at least one dog being displaceable away from said tooth-like projections, a backshell for supporting the conductors, said backshell having a tubular deformable portion that is installed over said adapter sleeve and held in place by deforming said deformable portion over a mating portion of said adapter sleeve, said backshell being engaged against rotation to said adapter sleeve, said backshell defining a stopping surface that prevents said at least one dog from displacing away from said tooth-like projections upon installation of said deformable portion over said adapter sleeve, wherein said adapter sleeve can rotate relative to said cylindrical extension before said deformable portion is installed due to said at least one dog being displaceable away from said tooth-like projections, and said adapter sleeve cannot rotate relative to said cylindrical extension after said deformable portion is installed due to said stopping surface preventing said at least one dog from displacing away from said tooth-like projections;

(b) severing said deformable portion from said backshell;

(c) removing said backshell;

(e) providing a new backshell having a new tubular deformable portion;

(f) inserting said adapter sleeve into said new deformable portion such that said new backshell is engaged against rotation to said adapter sleeve, said new backshell defining a stopping surface that restrains said at least one dog against said toothlike projections thereby preventing said adapter sleeve from rotating relative to said cylindrical extension; and, (g) deforming said new deformable portion over a mating portion of said adapter sleeve.

22. The method of claim 21, wherein said step of deforming said new deformable portion comprises the step of swaging said new deformable portion over a mating portion of said adapter sleeve.

* * * * *